United States Patent [19]

Sloan

[11] 4,409,645

[45] Oct. 11, 1983

[54] COMBINATION FLASHLIGHT AND AUXILIARY POWER PACK

[76] Inventor: Francis J. Sloan, 211 Holly St., Cranford, N.J. 07016

[21] Appl. No.: 310,287

[22] Filed: Oct. 9, 1981

[51] Int. Cl.[3] ..... F21L 7/00

[52] U.S. Cl. ..... 362/200; 60/200.1; 362/157; 362/184; 362/190; 362/191; 362/208; 362/253; 362/362; 362/457

[58] Field of Search ..... 60/200; 362/184, 190, 362/191, 200, 208, 157, 457, 253, 362

[56] References Cited

U.S. PATENT DOCUMENTS

| | | | |
|---|---|---|---|
| 3,798,439 | 3/1974 | Land et al. | 362/196 |
| 4,250,539 | 2/1981 | Leitzel et al. | 362/200 |
| 4,285,030 | 8/1981 | Menelly | 362/200 |
| 4,364,103 | 12/1982 | Harshbarger | 362/200 |
| 4,368,507 | 1/1983 | Reynolds | 362/253 X |

*Primary Examiner*—Stephen J. Lechert, Jr.
*Attorney, Agent, or Firm*—Omri M. Behr

[57] ABSTRACT

An auxiliary power pack and/or flashlight which accommodates spent instant photography film cartridges which include a substantially flat battery. A battery and electrical carrier subassembly is accommodated within a housing which serves as a covering shell and does not have depending therefrom any of the components of the device.

21 Claims, 6 Drawing Figures

COMBINATION FLASHLIGHT AND AUXILIARY POWER PACK

BACKGROUND OF THE INVENTION

1. Field Of The Invention

The present invention relates to flashlights and auxiliary power packs, and more particularly to a flashlight and/or auxiliary power pack which accommodates therein a substantially flat battery either alone or in an expended film cartridge.

2. Description Of The Prior Art

The many uses of portable hand held flashlights have been well known virtually since the time the first practical portable dry cell was manufactured. Additionally, the desirability of using an auxiliary power pack to power battery operated devices is well known. For instance, various radios, televisions, tape recorders, and movie cameras, which are battery operated, have a provision wherein a connector is provided so that an auxiliary power pack can be hooked into their respective systems to provide greater battery capacity than that provided by the battery compliment incorporated integrally in these individual devices.

At a time when maximum utilization of available resources has become imperative, the present invention permits the tapping of a presently unexploited power source for use as an auxiliary power supply and/or for use in powering a flashlight. Specifically, this heretofore unused power source comprises the substantially flat batteries which are incorporated in instant picture film pack cartridges. These film pack cartridges, presently sold by the Polaroid Corporation, incorporate a plurality of self-developing photographic image rendering units which are exposed in a camera and are self developed when ejected therefrom and squeezed by rollers. The exposure and motor driven developing inducing mechanisms of these cameras are powered by a substantially flat battery also disposed in the film cartridge. In order to insure adequate shelf life of the flat battery and to accommodate the relatively heavy current drain of the motor of the developing inducing mechanism of these cameras, the batteries, known under the trademark Polapulse, are substantially over designed. Even after all the film units of a cartridge have been exhausted over a period of time, a substantial power capacity remains in these Polapulse batteries. Heretofore, this untapped energy supply has been discarded as useless. Through use of the present invention, the Polapulse battery can be accommodated so that it can provide additional useful life to the purchaser which, as a net result, will provide a savings to the user.

Although variously configured flashlights and auxiliary power packs are well known in the art, such apparatuses are not known which accommodate a substantially flat Polapulse battery either removed from the film cartridge usually associated therewith, or still disposed therein as taught by the present invention. Additionally, the present invention teaches an apparatus including a housing and a carrier configured to be disposed therein. The electrical components of the apparatus are entirely mounted on the carrier which also accommodates the battery so that the carrier and all the electrical components can be removed as a unit from the housing to facilitate servicing. Such a housing and carrier arrangement has not previously been known. Typically, items such as switches, connectors, and electrical lamps are mounted directly to an apparatus housing. Through employment of the configuration of the present invention, greater manufacturing flexibility is recognized since a single carrier assembly can be accommodated in a plurality of differently styled housings. As a result, great manufacturing economy is achieved and reduced production costs can be realized if variously styled or decorated housings are provided. For instance, a single carrier having electrical components preassembled, mounted, and wired thereon might be slipped into a plastic case, a leather case, or a cardboard case each having different applications without the requirement of separate tooling and assembly of each individual case and the attendant mounting of components directly to the case.

SUMMARY OF THE INVENTION

Therefore, a primary object of the present invention is to provide a combination flashlight and auxiliary power pack.

A further object of the present invention is to provide a flashlight and/or power pack which is designed to exploit a presently untapped power source.

A still further object of the present invention is to provide a power pack and/or flashlight which will accommodate therein a film cartridge which incorporates a substantially flat battery and a plurality of photographic image rendering units therein.

Still another object of the present invention is to provide a power pack and/or flashlight which incorporates a carrier assembly for accommodating a battery and all the electrical components of the apparatus and a separate housing into which the carrier is inserted.

Another object of the present invention is to provide a flashlight and/or auxiliary power pack wherein the carrier portion thereof can be standardized so as to be compatible with a plurality of differently styled housings.

A still additional object of the present invention is to provide a flashlight and/or power pack which is readily pocketable.

Another still additional and further object of the present invention is to provide a flashlight and/or auxiliary power pack which is simple in design, relatively inexpensive to manufacture, rugged in construction, durable, easy to operate, and efficient in operation.

These objects, as well as further objects and advantages of the present invention, will become readily apparent after reading the ensuing description of the non-limiting illustrative embodiments and viewing of the accompanying drawing.

A flashlight and/or auxiliary power pack for accommodating therein at least one battery comprises, according to the principles of the present invention, a housing forming therein a chamber; a carrier for insertion in the chamber; electrical contact means mounted on the carrier for operably electrically contacting the terminals of the at least one battery; electrical connector means, if the apparatus is to be used as an auxiliary power pack, the electrical connector means being mounted on the carrier and being electrically coupled to the electrical contact means, the electrical connecting means being accessible from the exterior of the housing when the carrier is disposed in the housing chamber; and electrical illumination means, if the apparatus is to be used as a flashlight, the electrical illumination means being mounted on the carrier and being selectively electrically coupled to the electrical contact means, the electrical illumination means visible from outside the housing when the carrier is inserted therein.

BRIEF DESCRIPTION OF THE DRAWING

In order that the present invention may be more fully understood, it will now be described, by way of example, with reference to the accompanying figures in which.

DESCRIPTION OF THE PREFERRED EMBODIMENTS

Figure 1:
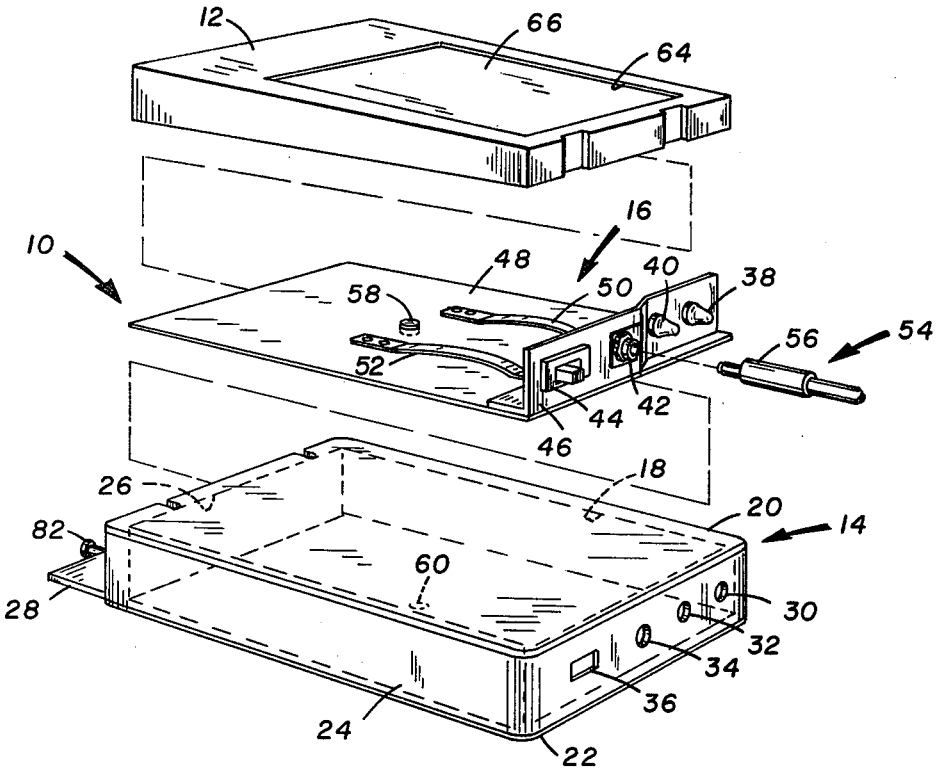
FIG. 1 is an exploded pictorial representation in perspective of one embodiment of the present invention.

Referring now to the figures, and more particularly to FIG. 1 thereof, there is illustrated therein a combination flashlight and auxiliary battery pack 10 which accommodates therein a film cartridge 12. The flashlight and auxiliary battery pack 10 includes a housing 14 and a carrier 16. The housing 14 forms a chamber 18 for accommodating therein the carrier 16. The carrier 16 accepts thereon and is configured to substantially conform in shape to the film cartridge 12, further illustrated in FIG. 2.

The housing 14, as illustrated, is formed from an upper plate 20, a lower plate 22, and a sidewall 24 disposed therebetween although other structural configurations can be employed. The upper plate 20, lower plate 22, and sidewall 24 form a mouth 26 which opens into the chamber 18 of the housing 14 as further illustrated in FIG. 3. The mouth 26 permits access to the chamber 18 and can be selectively covered by a cover 28, also as further illustrated in FIG. 3. The sidewall 24 of the housing has a plurality of apertures 30, 32, 34, and 36 disposed therethrough which accommodate therein respectively, electrical lamps 38 and 40, electrical connector 42, and switch 44 all mounted on an upstanding flange 46 fixedly secured to the base member 48 of the carrier 16. The lamps 38 and 40, the connector 42, and the switch 44 are electrically connected, as hereinafter described, to a pair of electrical contacts 50 and 52 which are of a flexible conductive material such as spring brass or the like and are fixedly secured to the base member 48 of the carrier 16. When the device 10 is employed as an auxiliary battery pack, a connecting cable 54 terminating at one end thereof with a connector 56 is employed. The connector 56 mates with the connector 42, the other end of the connecting cable 54 being supplied with a suitable connector configured to cooperate with the device which is to be powered.

The connecting cable 54 can be directly wired and a connector can only be provided at one end thereof. Similarly, connectors configured differently than that illustrated may be employed.

When the carrier 16 is inserted through the mouth 26 of the housing 14 and into the chamber 18 thereof, a pin 58, fixedly secured to the base member 48 of the carrier 16, is engaged by an aperture 60. The pin 58 is locked within the aperture 60 when the film cartridge 12 is inserted in the chamber 18 since the chamber 18 is dimensioned to snugly accommodate the film cartridge 12 thereby causing the film cartridge 12 to press firmly against the base member 48 of the carrier 16. Locking means other than the pin 58 and aperture 60 can be employed, if desired.

Figure 2:
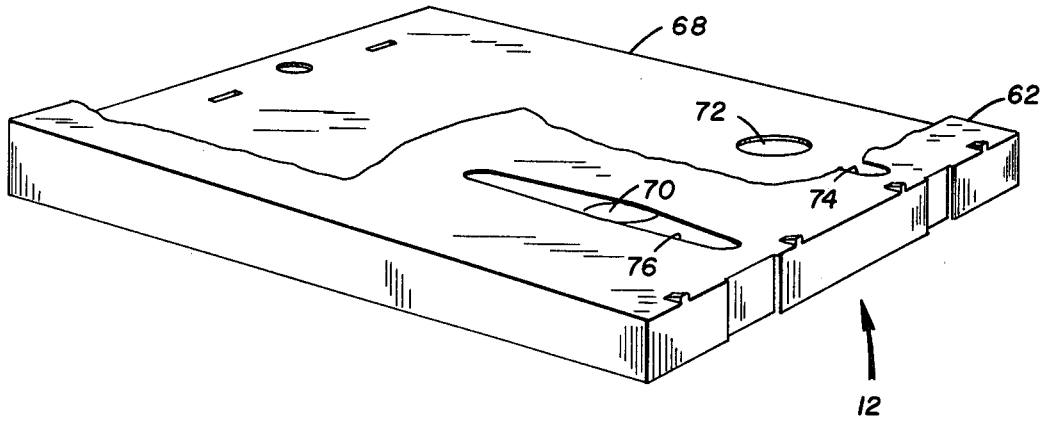
FIG. 2 is a partially broken away view in perspective of a film cartridge incorporating therein the substantially flat battery.

The film cartridge 12, as further illustrated in FIG. 2, is of a type sold by the Polaroid Corporation for use in instant picture cameras known generally as Polaroid SX-70's. The cartridge 12 includes a casing 62, an aperture 64 being disposed therein, the aperture 64 for presenting a plurality of photographic image rendering units disposed within the casing in an operative position for interaction with the optics of the camera. Also disposed within the casing 62 is a substantially flat battery 68, as shown in FIG. 2, known under the trademark Polapulse. The Polapulse battery is of a relatively new construction and its laminate structure and enclosure was designed for use in the film cartridge 12 for obvious packaging advantages. The Polapulse battery has a pair of electrical contacts 70 and 72 which are electrically connected to the poles of the battery. These electrical contacts are accessed through the casing 62, respectively, by a pair of apertures 74 and 76. The battery 68 is readily removable from the casing 62 if desired and therefore may be employed for purposes hereinafter discussed in conjunction with FIG. 6. When the film cartridge 12 is placed upon the carrier 16, in a manner suggested by the dashed assembly lines of FIG. 1, the electrical contacts 50 and 52 frictionally engage, respectively, the battery contacts 70 and 72 permitting utilization of the battery 68.

Figure 3:
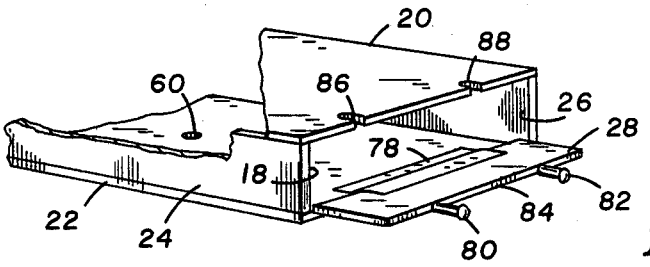
FIG. 3 is a partially broken away fragmentary rear view in perspective of the housing of the present invention.

With reference to FIG. 3, the operation of the cover 28 can be understood. The cover 28 is hingedly secured to the lower plate 22 of the housing 14 by hinge material 78. The hinge material 78 may comprise an adhesive mounted living type hinge, or another suitable hinge configuration can be employed. A pair of round headed locking pins 80 and 82 are disposed on an edge 84 of the cover 28 and are frictionally engaged by and selectively retained in, respectively, a pair of apertures 86 and 88, the pins 80 and 82 and the apertures 86 and 88 thereby forming means for locking the cover 28 in a closed position. Of course, other suitable locking means such as clasps, protrusions and detents, conventionally engaging locking members or the like may be employed.

The component elements of the housing 14 may be fabricated from any suitable material such as plastic, leather, wood, cardboard, or the like. These components can be styled, dressed, and altered in configuration to suit the purposes and application of the user. For instance, a very elegant flashlight and auxiliary power pack can be provided by fabrication of a housing from leather, while an extremely inexpensive and eventually disposable unit can be fabricated from cardboard possibly decorated with advertising material. One of the advantages such flexibility provides is that a single carrier assembly 16 can be fabricated and can be accommodated in a plurality of differently configured housings. Additionally, if a housing is for some reason damaged or destroyed, it can be replaced with a housing of similar or different design while the owner can retain and reuse the basic carrier assembly. Furthermore, since the carrier has all the electrical components of the devices mounted thereon, this facilitates servicing because the carrier can be removed, readily presenting all the items to be serviced. Similarly, this provides for expedient manufacture since housings and carriers can be separately tooled and no inaccessible component assembly within the housing is necessitated since the carrier is separately fabricated.

Figure 5:
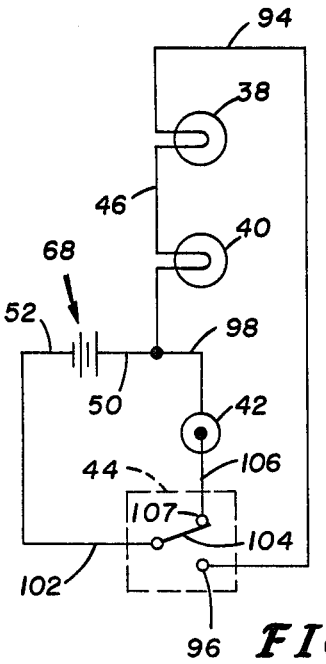
FIG. 5 is a schematic of the wiring of the embodiment of FIG. 1.
Figure 4:
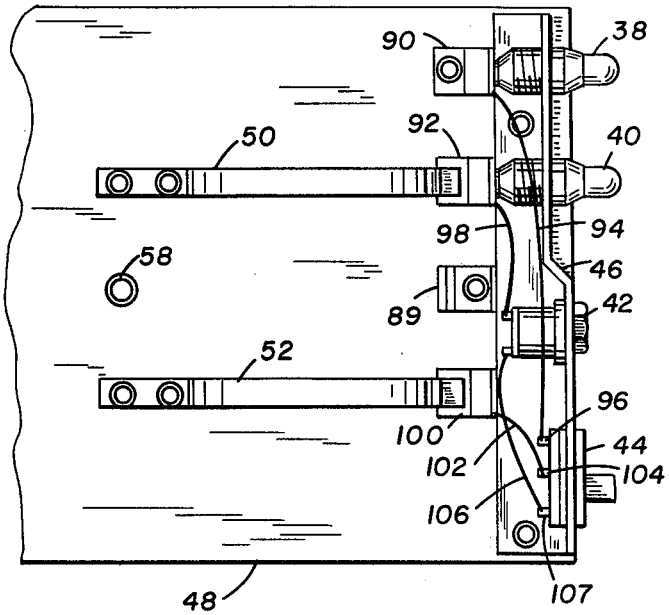
FIG. 4 is a fragmentary top plan view of the carrier of the present invention from the embodiment illustrated in FIG. 1.

With reference to FIGS. 4 and 5, the manner in which the electrical components of the present invention are coupled together can be understood. A stop 89 is fixedly secured to the base member 48 and helps to register the cartridge 12 relative to the contacts 50 and 52. The upstanding flange 46 is constructed of a conducting material, and the lamps 38 and 40 are mounted in threaded apertures disposed therein, electrical connection of the threaded envelopes of the lamps 38 and 40 being made through the upstanding flange 46. The rear contacts of the lamps 38 and 40 engage, respectively, a pair of contacts 90 and 92 which are fixedly secured to the base member 48 of the carrier 16, the base member 48 being constructed of a nonconductive material. The contact 90 is connected by a wire 94 to a contact 96 of switch 44. The contact 92 is connected to one side of the connector 42 by a wire 98. Contact 92 is also engaged by electrical contact 50 which is electrically connected to the battery 68 when the cartridge 12 is disposed on the carrier 16. Electrical contact 52, which also engages the battery 68, is in contact with a contact 100 fixedly secured to the base member 48. A wire 102 connects the contact 100 to the wiper contact 104 of the switch 44. The other side of the connector 42 is connected by a wire 106 to a contact 107 of the switch 44. When the switch 44 is in a position wherein the wiper 104 contacts the contact 96, the lamps 38 and 40 are lit and when the wiper 104 contacts the contact 107, the connector 42 is powered.

It should be apparent to one of ordinary skill in the art that the apparatus of the present invention can be employed with other lamp or circuit configurations or the lamps and switch can be entirely deleted. Similarly, connector 42 may or may not be provided depending upon whether or not the apparatus 10 is to be used as an auxiliary power pack. The lamps 38 and 40 are of a voltage half of that provided by the Polapulse battery (normally 6 V) and therefore are in series. Of course, other voltage lamps, either singly or in combination, in series or parallel, may be employed and other similar devices can be used. Additionally, lamps configured other than the self-focusing lamps illustrated can be employed. Although switch 44 is illustrated as being of the slide type, other type switches can be employed such as toggle switches, momentary push button switches, or the equivalent.

Figure 6:
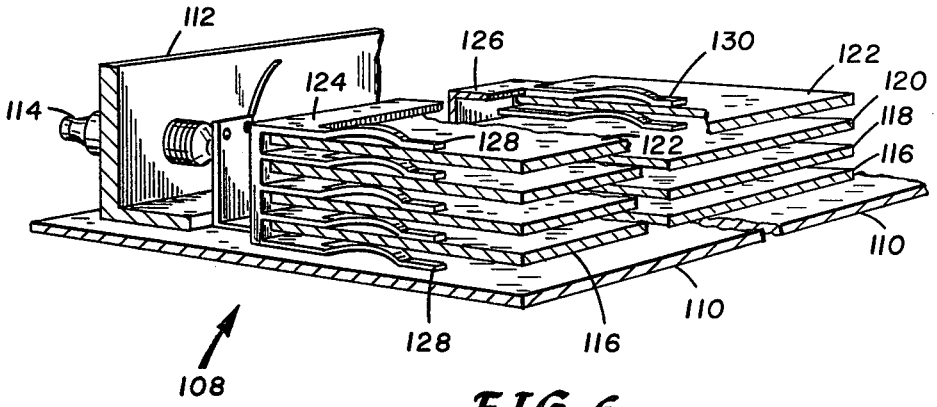
FIG. 6 is a fragmentary partially broken away view in perspective of an alternate carrier embodiment of the present invention.

Referring now to FIG. 6, there is illustrated therein an alternate carrier 108 constructed within the teachings of the present invention for accommodating a plurality of Polapulse batteries sans film cartridge. The carrier 108 includes a base member 110 and an upstanding flange 112 fixedly secured thereto, similar in operation and function to the like components shown and described previously. A lamp 114 is shown mounted in the flange 112, and an additional lamp, an electrical connector, and a switch also may be provided. The importance of FIG. 6 is in that it shows an alternate configuration for engaging the electrical contacts of the Polapulse battery. The carrier 108 is constructed to accommodate a plurality of Polapulse batteries 116, 118, 120, and 122. The batteries 116 through 122 are accommodated by a pair of multifaced electrical contacts 124 and 126. The electrical contacts 124 and 126 are constructed of a conductive flexible material and provide a plurality of stacked contacting elements 128 and 130. The contacting elements 128 and 130 serve the dual purpose of engaging the electrical contacts of the batteries 116 through 122 and also serve as a frictional mounting for the batteries, the batteries 116 through 122 being sandwiched in between the contacting elements 128 and 130 as illustrated.

All of the contacting elements 128 of the electrical contact 124 are electrically coupled together and all of the contacting elements 130 of the electrical contact 126 are similarly connected. As a result, the batteries 116, 118, 120, and 122 are effectively wired together in parallel. The electrical contacts 124 and 126 are electrically coupled to the balance of the circuit on the carrier 108 and function in a manner substantially the same as the single battery of the previously described configuration with the distinction of added power capacity. As a result of this added power capacity provided through the use of a plurality of parallel batteries which have been removed from their cartridges, several batteries can be disposed in the same space necessary to accommodate a single film cartridge and, through this increased capacity, devices to be powered with heavier current drains can be accommodated or an apparatus which provides a longer life is presented. Although the embodiment of FIG. 6 is illustrated incorporating four substantially flat batteries, it should be obvious to one of ordinary skill in the art that any number of batteries can be accommodated by varying the number of contacting elements 128 and 130. The carrier 108 is designed to fit within the same housing as the previously described carrier 116 and therefore the carriers may be used interchangeably in the same housings.

It should be understood that various changes in the details, materials, arrangements of parts, and operational conditions which have been herein described and illustrated in order to explain the nature of the invention may be made by those skilled in the art within the principles and scope of the invention.

I claim:

1. A power pack for accommodating therein at least one battery comprising:

a housing forming a chamber therein;

a carrier for insertion in said chamber;

electrical contact means mounted on said carrier for operably electrically contacting the terminals of said at least one battery; and electrical connector means mounted on said carrier, said electrical connector means being electrically coupled to said contact means and being accessible from the exterior of said housing when said carrier is disposed in said housing chamber.

2. A power pack in accordance with claim 1, wherein said housing comprises a mouth opening into said chamber and being dimensioned to accept therethrough said carrier and said at least one battery, said housing further comprising means for selectively covering said mouth.

3. A power pack in accordance with claim 1, further comprising means for selectively securing said carrier in said housing.

4. A power pack in accordance with claim 1, wherein said carrier is configured to accommodate one battery, said battery being of a substantially flat type.

5. A power pack in accordance with claim 4, wherein said battery provides flat friction engageable contacts, said electrical contact means comprising a pair of flexible conductive elements fixedly secured to said carrier and for engaging said friction engageable contacts of said at least one battery, insertion of said battery and said carrier in said chamber of said housing forcing said battery against said carrier to effect contact of said flexible conductive elements and said friction engageable contacts of said battery.

6. A power pack in accordance with claim 1, wherein said carrier and said housing chamber are configured to accommodate a plurality of batteries, each of said batteries providing flat friction engageable contacts, said electrical contact means comprising a pair of flexible conductive elements each configured to form a plurality of stacked surfaces for engaging said battery contacts so as to permit stacking of said batteries and simultaneous electrical contact between said battery contacts and said conductive elements.

7. A power pack in accordance with claim 1, further comprising illumination means mounted on said carrier and visible outside said housing, said illumination means being selectively coupleable to said electrical contact means.

8. A power pack in accordance with claim 1, wherein said at least one battery is mounted in a cartridge configured for also accommodating therein a plurality of photographic image rendering units, said housing chamber dimensioned to accommodate said cartridge, the shape of said carrier conforming substantially to the shape of said cartridge.

9. A flashlight adapted to be powered by at least one internally disposed battery comprising:

a housing forming therein a chamber;

a carrier for insertion in said chamber;

electrical contact means mounted on said carrier for operably electrically contacting the terminals of said at least one battery; and electrical illumination means mounted on said carrier and being selectively electrically coupled to said electrical contact means, said electrical illumination means being visible from outside said housing when said carrier is inserted therein.

10. A flashlight in accordance with claim 9, wherein said housing comprises a mouth opening into said chamber and being dimensioned to accept therethrough said carrier and said at least one battery, said housing further comprising means for selectively covering said mouth.

11. A flashlight in accordance with claim 10, wherein said means for selectively covering said mouth comprises a hingedly affixed cover and means for selectively securing said cover over said mouth.

12. A flashlight in accordance with claim 9, further comprising means for selectively securing said carrier in said housing.

13. A flashlight in accordance with claim 12, wherein said selective securing means comprises a pin fixedly secured to said carrier and a complementary mating hole disposed in said housing, insertion of said carrier in said housing chamber causing said hole to capture said pin, insertion of said battery in said housing chamber locking said pin in said hole.

14. A flashlight in accordance with claim 9, wherein said carrier is configured to accommodate one battery, said battery being of a substantially flat type.

15. A flashlight in accordance with claim 14, wherein said battery provides flat friction engageable contacts, said electrical contact means comprising a pair of flexible conductive elements fixedly secured to said carrier and for engaging said friction engageable contacts of said at least one battery, insertion of said battery and said carrier in said chamber of said housing forcing said battery against said carrier to effect contact of said flexible conductive elements and said friction engageable contacts of said battery.

16. A flashlight in accordance with claim 9, wherein said carrier and said housing chamber are configured to accommodate a plurality of batteries, each of said batteries providing flat friction engageable contacts, said electrical contact means comprising a pair of flexible conductive elements each configured to form a plurality of stacked surfaces for engaging said battery contacts so as to permit stacking of said batteries and simultaneous electrical contact between said battery contacts and said conductive elements.

17. A flashlight in accordance with claim 9, wherein said electrical illumination means is selectively coupled to said electrical contact means by a switch.

18. A flashlight in accordance with claim 17, further comprising electrical connector means mounted on said carrier, said electrical connector means being selectively electrically coupled by said switch to said contact means and being accessible from the exterior of said housing when said carrier is disposed in said housing chamber.

19. A flashlight in accordance with claim 18, wherein said switch couples said connector to said contact means only when said switch is not coupling said electrical illumination means to said contact means.

20. A flashlight in accordance with claim 9, wherein said at least one battery is mounted in a cartridge configured for also accommodating therein a plurality of photographic image rendering units, said housing chamber dimensioned to accommodate said cartridge, the shape of said carrier conforming substantially to the shape of the cartridge.

21. A flashlight and auxiliary power pack for utilizing flat batteries disposed in cartridges configured for also accommodating therein a plurality of photographic image rendering units comprising:

a housing forming therein a chamber;

a carrier for insertion in said chamber, said carrier configured to conform substantially to said cartridge;

electrical contact means mounted on said carrier for operably electrically contacting the terminals of said battery when said cartridge is placed in said carrier;

electrical illumination means mounted on said carrier and being selectively electrically coupled to said electrical contact means, said electrical illumination means being visible from outside said housing when said carrier is inserted therein;

electrical connector means mounted on said carrier, said electrical connector means being selectively electrically coupled to said contact means and being accessible from the exterior of said housing when said carrier is disposed in said housing chamber; and electrical switch means for selectively coupling said electrical illumination means and said electrical connector means to said electrical contact means.

* * * * *